United States Patent [19]

McCarty

[11] 4,346,565

[45] Aug. 31, 1982

[54] GRAVITY DEFROST

[75] Inventor: William J. McCarty, Louisville, Ky.

[73] Assignee: General Electric Company, Louisville, Ky.

[21] Appl. No.: 270,478

[22] Filed: Jun. 4, 1981

[51] Int. Cl.[3] ..... F25D 21/06; F25B 41/00; F25B 47/00

[52] U.S. Cl. ..... 62/151; 62/196 C; 62/225; 62/278

[58] Field of Search ..... 62/196 C, 196 R, 81, 62/277, 278, 324.6, 324.5, 159, 160, 225, 151

[56] References Cited

U.S. PATENT DOCUMENTS

| | | | |
|---|---|---|---|
| 2,774,219 | 12/1956 | Kelley | 62/196 C |
| 2,878,657 | 3/1959 | Atchison | 62/325 |
| 3,159,981 | 12/1964 | Huskey | 62/156 |
| 3,370,437 | 2/1968 | Jacobs | 62/160 |
| 3,511,060 | 5/1970 | Bodcher | 62/140 |
| 3,555,842 | 1/1971 | Bodcher | 62/140 |
| 3,871,187 | 3/1975 | Skvarenina | 62/196 |
| 4,027,497 | 6/1977 | Thurman | 62/156 |
| 4,158,950 | 6/1979 | McCarty | 62/278 |
| 4,285,210 | 8/1981 | McCarty | 62/160 |
| 4,286,435 | 9/1981 | Cann et al. | 62/196 R |

FOREIGN PATENT DOCUMENTS

| | | | |
|---|---|---|---|
| 52-9146 | 1/1977 | Japan | 62/81 |

*Primary Examiner*—Albert J. Makay
*Assistant Examiner*—Harry Tanner
*Attorney, Agent, or Firm*—Frank P. Giacalone; Radford M. Reams

[57] ABSTRACT

A reverse air cycle type heat pump is provided that utilizes a refrigeration system having a unidirection refrigerant flow wherein the condenser and evaporator retain their functions, but the air directed across them is redirected for different operations. The refrigeration system employed in the air cycle type heat pump is further provided with a secondary defrost circuit that includes the system liquid line and a conduit having a valve which permits refrigerant flow to bypass the compressor upon termination of compressor operation. A sensing means associated with the system expansion device is arranged on the suction line in a manner that allows the expansion device to regulate the flow of refrigerant through the liquid line in the normal manner when the compressor is operating, while allowing unrestrictive refrigerant flow through the liquid line when compressor operation terminates and the system pressure differential is equalized. This defrost circuit causes the relatively warm refrigerant in gaseous phase in the condenser to displace the relatively cold refrigerant in liquid phase in the evaporator with the flow continuing until the defrost process is completed.

2 Claims, 1 Drawing Figure

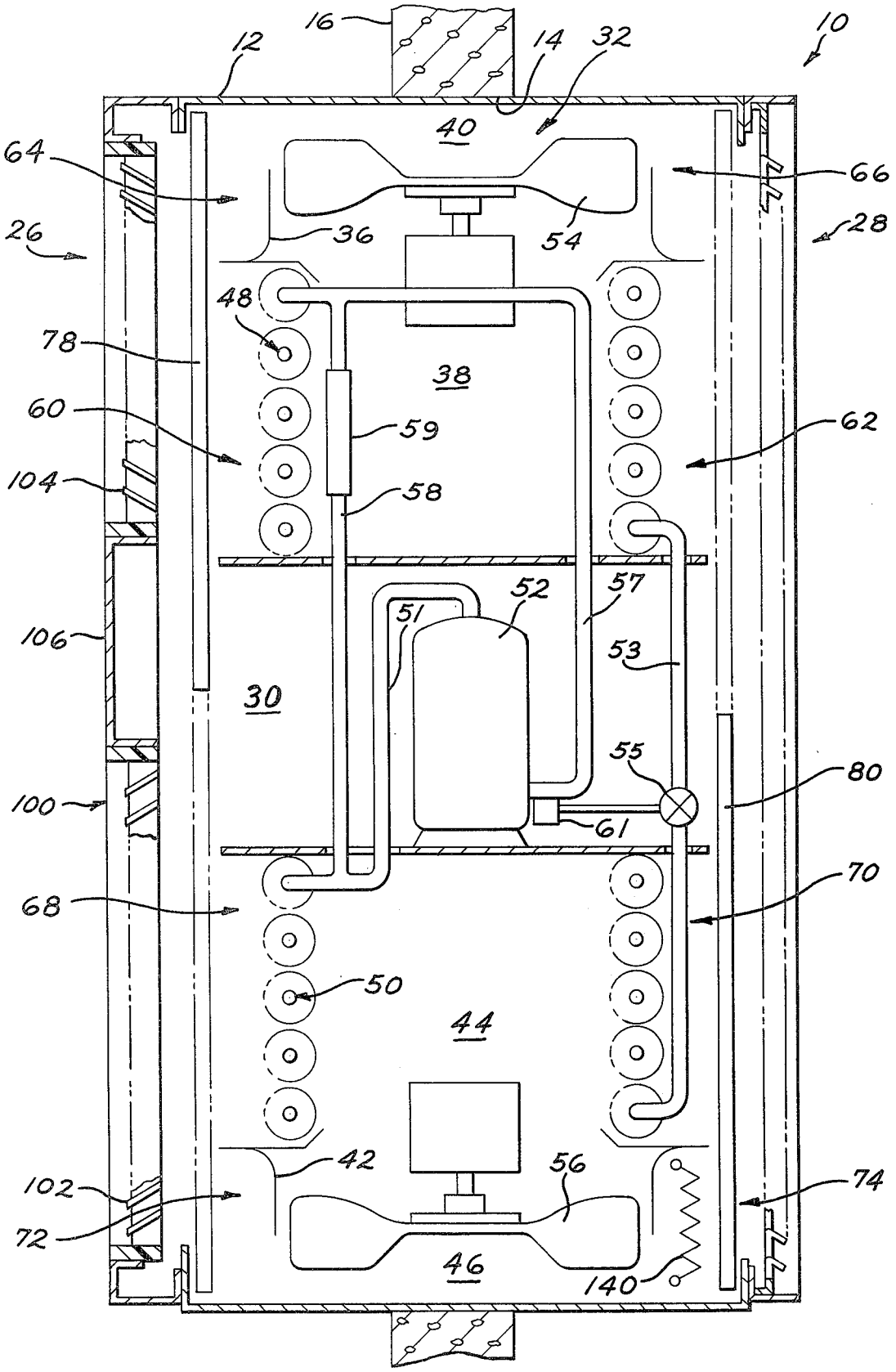
16
12
14
32
10
40
64
66
26
36
54
28
48
78
38
60
59
62
104
58
52
57
51
106
53
30
55
80
100
61
70
68
50
44
42
56
102
74
72
46
140

GRAVITY DEFROST

BACKGROUND OF THE INVENTION

The reverse air cycle type of heat pump utilizes unidirection refrigerant flow wherein the condenser and evaporator retain their functions, but the air directed across them is redirected for different operations. While the heat pump is operating in the cooling mode, outdoor air is passed in heat exchange relationship with the condenser for liquifying the refrigerant and outside again; and indoor air is passed in heat exchange relationship with the evaporator for cooling the air and recirculated again. Conversely, in the heating mode, outdoor air passes in heat exchange relationship with the evaporator for vaporizing the refrigerant, then outside again; and indoor air is passed in heat exchange relationship with the condenser for heating the air and circulated again.

One prior art U.S. Pat. No. 2,878,657-Atchison, assigned to General Electric Company, the assignee of the present invention, discloses a heat pump wherein the air conditioning unit includes a plurality of air controlling valves each of which is associated with an opposed inlet and outlet opening of the unit that permit selective control of the air flowing into and discharging from the unit in order to direct air either from the outside or from within the enclosure over either of the heat exchangers disposed within separate compartments of the unit.

Under certain operating conditions in the heating cycle, evaporator may operate at such low outdoor ambient temperatures as to cause the accumulation of a coating or layer of frost on its surface. Since frost when it accumulates operates as a barrier to heat transfer between the evaporator and the air being circulated thereover, the efficiency of the unit is markedly reduced. Further, unless means are provided for interrupting the accumulation of frost, the evaporator can become completely filled with a layer of frost that may effectively block air passage therethrough. This blockage of air results in the loss of heat exchange and if allowed to continue can cause refrigeration system components to fail and can also result in compressor burn-out unless compressor operation is terminated.

In U.S. Pat. No. 3,555,842-Bodcher, a defrost line connects the upper inlet of the condenser to the upper inlet of the evaporator and includes a defrost valve which is closed during operation of the compressor but opens when compressor operation terminates. A return line connects the evaporator collector with the lower part of the condenser and includes a valve which operates in the same manner as the defrost valve.

In U.S. Pat. No. 4,158,950-McCarty, assigned to the General Electric Company, assignee of the present invention, there is disclosed a defrost arrangement for refrigeration system of the reverse air cycle type. A secondary defrost circuit is provided which permits refrigerant flow to by-pass the compressor when compressor operation terminates.

In patent application Ser. No. 144,795-McCarty, filed Apr. 28, 1980, U.S. Pat. No. 4,285,210, assigned to the General Electric Company, the assignee of the present invention, a defrost arrangement for a refrigeration system is employed in a reverse air cycle heat pump wherein the system compressor and expansion device are bypassed during defrost.

SUMMARY OF THE INVENTION

It is an object of the present invention to control the refrigeration system expansion valve in a manner that permits accurate regulated refrigerant flow between the condenser and evaporator during operation of the system during either the cooling or heating mode, while providing unrestricted flow of refrigerant when the refrigeration system compressor is inoperative.

The present invention provides a gravity defrost arrangement in a refrigeration system of the type having a refrigerant capable of boiling under relatively low pressure to absorb heat and condensing under relatively high pressure to expel heat. The refrigerant system includes a compressor having an inlet and outlet. The condenser has its inlet connected to the compressor outlet through a discharge line, with its outlet connected through the expansion device arranged in the liquid line to the inlet of the evaporator with the outlet of the evaporator connected to the compressor inlet through the suction line to complete the refrigerator system.

The defrost means includes a sensing means that is associated with the system expansion device in the liquid line, and a defrost flow conduit connected between the condenser inlet and the evaporator outlet. The sensing means is arranged at a point in the suction line relative to the compressor so that refrigerant flow through the liquid line between condenser and evaporator during operation of the compressor is regulated to insure efficient evaporator operation while at the same time being at a location in the suction line so as to be responsive to the temperature of refrigerant migrating from the compressor when the compressor operation terminates to provide an unrestricted refrigerant flow through the liquid line. A valve is arranged in the defrost conduit that is operable to a closed position by the pressure differential created by compressor operation to prevent refrigerant flow through the defrost conduit, and to an open position when the refrigerant pressure differential is bled down through the expansion device after the compressor operation terminates. This arrangement of an open defrost conduit and liquid line provides an unrestricted flow path through the defrost conduit between the upper portions of the condenser and evaporator and simultaneously through the liquid line between the lower portions of the condenser and evaporator. This unrestricted refrigerant flow path allows the warmer gaseous refrigerant, when present in the condenser, to flow through the defrost conduit into the upper portion of the evaporator to raise the temperature of the evaporator sufficiently to melt frost therefrom, while the temperature of the suction conduit adjacent the compressor raised by refrigerant migrating into the line from the compressor causes the sensor to open the expansion device to allow liquid refrigerant, when present in the lower portion of the evaporator, to flow through the unrestricted liquid line into the lower portion of the condenser.

DESCRIPTION OF THE DRAWING

The single FIGURE is a side elevational view of a reverse air cycle heat pump air conditioning unit showing a schematic of the refrigeration system incorporating the present invention.

DESCRIPTION OF THE PREFERRED EMBODIMENT

Referring now to the drawing, there is shown an air conditioning unit 10 of the reverse air cycle type fully disclosed in the above mentioned patent application Ser. No. 144,795-McCarty, filed Apr. 28, 1980, and said application is hereby incorporated by reference.

Air conditioning unit 10 includes a housing 12 that is adapted to be arranged in an opening 14 in the wall 16 of an enclosure to be conditioned. The housing walls define generally a front opening 26 disposed on the enclosure side of wall 16 and a rear opening 28 disposed in the outdoor side of the wall 16. The housing is divided by a central machine chamber 30 to include an upper evaporator compartment 32 and a lower condenser compartment 34. A fan shroud 36 substantially divides the evaporator compartment 32 into an inlet area 38 and an outlet area 40. A fan shroud 42 substantially divides the condenser compartment 34 into an inlet area 44 and an outlet area 46. Mounted in the housing 12 is an evaporator 48 arranged in the inlet area 38 of compartment 32, a condenser 50 arranged in the inlet area 44 of compartment 34, and the compressor 52 arranged in the chamber 30. Air is circulated by a fan 54 in shroud 36 from the evaporator inlet area 38 to the outlet area 40 and similarly air is circulated by a fan 56 in shroud 42 from the condenser inlet area 44 to outlet area 46. The closed circuit refrigerator system includes a discharge line 51 connected from the compressor to the condenser inlet arranged in the upper portion of the condenser. The liquid line 53 including the flow control means or expansion device 55 is connected to the outlet of the condenser arranged at the lower end thereof and the inlet of the evaporator arranged at the lower end thereof. The suction line 57 is connected between the outlet of the evaporator arranged at the upper end thereof and the compressor inlet.

The inlet and outlet areas of the evaporator and condenser compartments are arranged the housing 12 with each area having a pair of openings therein, one communicating with the opening 28 facing the outdoor, and a second opening communicating with the opening 26 facing the enclosure whereby air can be both introduced and discharged from the evaporator and condenser compartments in two different directions. More specifically, the evaporator inlet area 38 contains openings 60 and 62 and the outlet area 40 contains openings 64 and 66 in the indoor and outdoor side respectively of housing 12. Similarly, condenser compartment inlet area 44 is provided with openings 68 and 70 and the outlet area 46 is provided with openings 72 and 74 in the indoor and outdoor side respectively of housing 12.

A pair of dampers or air valves 78 and 80 are provided for controlling air flow through the compartments 32 and 34 which are arranged for vertical movement in openings 26 and 28 respectively. The dampers 78 and 80 are interconnected by suitable cables (not shown) to insure proper location of one damper over a compartment inlet and outlet on one side of the housing by movement of the damper arranged on the other side of the housing. The cable system interconnecting the indoor and outdoor dampers is fully explained in the above mentioned application Ser. No. 144,795.

In the heating mode, the dampers 78 and 80 are arranged in the position shown wherein air flow through the condenser chamber 34 is used to heat the air circulated from the enclosure. That is in the heating mode, the damper 78 closes the evaporator compartment inlet opening 60 and outlet opening 64 on the enclosure side opening 26 of housing 12 so that outdoor air is circulated through evaporator compartment 32 and, the damper 80 closes the condenser compartment inlet opening 28 of housing 12 so that enclosure air is circulated through the condenser compartment 34 to warm the enclosure air recirculating therethrough. In the cooling mode, the indoor damper 78 would be positioned over the enclosure side condenser inlet 68 and outlet 72 area opening, and the outdoor damper 80 would be positioned over the outdoor side evaporator inlet 62 and outlet 66 area opening so that outdoor air is circulated through the condenser chamber 34 and enclosure air is circulated through the evaporator chamber 40 to cool the enclosure air.

Arranged over the front or indoor opening 26 of housing 12 is a front grille or appearance member 100 that includes a louvered portion 104 positioned over inlet 60 and outlet 64 of evaporator chamber 32 and a louvered portion 102 positioned over the inlet 68 and outlet 72 of the condenser chamber. A central control panel 106 is located between louvers 102 and 104 and generally positioned in the area of chamber 30 between the compartments 32 and 34.

In the course of this unit operating in the heating mode, water vapor under certain ambient conditions condenses on the evaporator through which as explained hereinbefore outdoor air passes. In some instances, the amount of water vapor available in the outdoor ambient is great enough to solidify and form a layer of frost which blocks air flow through the heat exchanger. This layer of frost must be removed when it has a thickness which opposes the desirable transfer of heat from the heat exchanger. Accordingly, by the present invention, means are provided that permit defrosting and elimination of frost when present in the evaporator each time operation of the system compressor terminates. In its preferred application, the present embodiment of the defrost system is intended to be used in defrosting the evaporator in a manner that will not completely interrupt the heating process of the enclosure air.

The refrigeration system including the means for effecting the defrosting of the evaporator as shown in the drawing includes the liquid line 53 which is connected between condenser outlet located in the lower portion of condenser 50 and the evaporator inlet located in the lower portion of the evaporator 48. The system expansion valve 55 is arranged in liquid line 53 and is controlled in a manner to be fully explained hereinafter to function both to regulate the flow of refrigerant between the condenser and evaporator, and to provide an unrestricted flow for refrigerant during defrost. A defrost flow conduit or bypass line 58 is connected between the outlet or upper portion of the evaporator 48 adjacent suction line 57 and the inlet or upper portion of the condenser 50 adjacent the discharge line 51. In effect, a circuit or refrigerant flow through line 58 will bypass the compressor 52. The defrost circuit provided by the present invention is through a closed loop provided by liquid line 53 and conduit 58 and heat exchangers 48 and 50 with the compressor 52 being bypassed. Means are provided to prevent refrigerant flow through conduit 58 when the compressor 52 is circulating refrigerant during normal operation of the refrigerating system. To this end, valve 59 is provided in the conduit 58.

The valve 59 is designed to close when a pressure differential is present in the system. Since this pressure differential is created by compressor operation, valve 59 will remain closed when the system compressor is operating. Accordingly, the added defrost flow conduit 58 and its respective valve 59 has no effect on the refrigeration system during its normal operation. Further, the valve 59 is designed to remain closed for a period of time after the compressor operation terminates until the system pressure differential created by the operating compressor is fed or bled down in the normal manner through the system expansion valve 55 at which time valve 59 will open. As will be explained hereinafter, refrigerant flow through the expansion device is controlled by a sensor 61. By the present invention, the sensor is located on the suction line at a point relative to the compressor that allows regulated flow of refrigerant to the evaporator during normal operation of the system, while allowing an unrestricted flow of refrigerant when compressor operation terminates.

When the compressor is not operating, the relatively warmer refrigerant in the compressor casing will migrate into the suction line 57 to raise the temperature of the refrigerant therein. The location of the sensor 61 relative to the compressor is selected so that it will sense this warmer refrigerant from the compressor casing thereby causing the valve 55 to move into its fully open position. The exact location of the sensor 61 relative to the compressor may vary between refrigeration systems and the exact position or point the sensor must be located at must be determined for each system.

In operation with the unit in the heating mode and a frost condition sensed on the evaporator 48 compressor operation will terminate. At this time, as mentioned above, with the compressor 52 not operating the system pressure differential will bleed down through the system expansion valve 55. Accordingly, the valve 59 being no longer under the influence of the pumped refrigerant flow will move to an open position and a non-restricted refrigerant defrost flow path through conduit 58 and liquid line 53 between the lower and upper portions of the heat exchangers is established. Hot gaseous phase refrigerant will flow from the upper portion of the condenser 50 through conduit 58 and into the upper portion of the frosted evaporator 48. The liquid refrigerant in the lower portion of the evaporator 48, which is relatively cool, flows through the open expansion valve 55 in line 53 into the lower portion of the warmer condenser 50 where it is heated and returns to gaseous phase.

The liquid refrigerant accumulated in the frosted evaporator 48 will drain into the condenser 50 containing gas due to a gravity head created by the accumulated liquid height and the location of the evaporator above the condenser. The cold liquid at approximately 32° F. in the evaporator will absorb heat from the warm condenser and will change to gas. As liquid drains from the bottom of the evaporator through the open expansion means under influence of the relatively warm portion of the suction line adjacent the compressor, warm gas will enter the top through conduit 58. This flow of cold liquid refrigerant out of the bottom of evaporator through line 53 to the warm condenser, and the flow of warm refrigerant gas out of the top of the condenser through conduit 58 to the cold evaporator produces an effective defrosting cycle that will continue until the temperature of the evaporator approaches the temperature of the condenser. At this point, gravity flow will terminate because liquid can accumulate in both heat exchangers.

Heat added to the refrigerant during the defrosting comes from the warm condenser which is in a relatively warm indoor ambient in the heating mode. To insure that the temperature of the refrigerant in the condenser returns to gaseous state an auxiliary heater 140 together with fan 56 can be employed to provide warm air flow through the condenser 50. While the heater 140 and fan 56 may be energized to provide auxiliary heat during peak demands, it also provides heat to the enclosure during the defrosting operation. The heater function during the defrosting or compressor-off period in the heating mode is effective in maintaining the temperature of the condenser 50 equal to or slightly below the enclosure ambient and, in fact, elevated enough to ensure that the 32° F. liquid refrigerant entering the bottom portion of the condenser is returned to the evaporator through line 58 in gaseous phase.

The defrost circuit through the defrost flow conduit 58 as mentioned above is automatic as the valve 59 opens each time compressor operation terminates. By the present invention, the defrost flow through and liquid line 53 is effected by the use of the system expansion valve 55 and more particularly in the manner in which the valve 55 is controlled. In carrying out the embodiment shown of the present invention, the expansion valve was Type B1E manufactured by the Spartan Valve Company. Refrigerant flow through the valve is controlled by the temperature responsive sensor 61 and, more importantly, by its location on the suction line 57 relative to the compressor 52. To this end, the sensor 61 employed to regulate the flow of refrigerant through the expansion valve 55 is arranged to sense the temperature of the suction line 57 generally in the vicinity of the compressor casing. This location of the sensor 61 on suction line 51 relative to the compressor casing is effective in allowing proper refrigerant flow regulation between the condenser and evaporator during normal operation of the refrigeration system in the normal manner. That is, the valve regulates the flow of liquid refrigerant to the evaporator in exact proportion to the rate of evaporation of the liquid refrigerant in the evaporator while permitting superheat to take place in the suction line. It should be noted that when compressor operation terminates the temperature of the refrigerant in the compressor casing will be elevated by the relatively warm compressor components and will migrate into a portion of the suction line 57. The migration of this relatively warm refrigerant into the suction line is influenced by the high pressure conditions in both the condenser 50 and compressor 52. During the compressor off period or defrost mode, the sensor 61 by its location adjacent the compressor casing will be exposed to this relatively warmer refrigerant as it migrates out of the compressor suction opening located in the lower portion of the compressor casing and, accordingly, the sensor 61 influenced by this warmer refrigerant will cause the valve 55 to move into its fully open position to provide unrestricted flow of refrigerant between the evaporator and condenser in the manner explained above during defrost.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A refrigeration system for use in a reverse air cycle type heat pump, said refrigeration system being of the type having a refrigerant capable of boiling under relatively low pressure to absorb heat and condensing under relatively high pressure to expel heat comprising:

a compressor casing for containing a high pressure refrigerant, said casing having an inlet port and an outlet port;

a compressor in said casing for compressing said refrigerant in gaseous phase;

a condenser having a first opening in the upper portion and a second opening in the lower portion thereof;

a discharge conduit connecting said condenser first opening to said compressor outlet;

an evaporator arranged above said condenser and said compressor having a first opening in the upper portion and a second opening in the lower portion thereof;

a liquid conduit connecting the second openings in the lower portion in each of said condenser and said evaporator;

a suction conduit connecting said first opening of said evaporator to said compressor inlet;

a means for regulating the flow of refrigerant through said liquid conduit including a flow control means in said liquid conduit, a temperature responsive sensing means for controlling the flow of refrigerant through said flow control means, said temperature responsive means is arranged to sense the temperature of refrigerant in said suction line at a point relative to said compressor wherein the temperature of refrigerant at said point is in a range that will cause said sensing means to effectively control the flow of refrigerant through said flow control means during operation of said compressor at a flow rate which insures efficient operation of said evaporator and being responsive to the temperature of high pressure refrigerant migrating from said compressor casing to said point when said compressor operation terminates to provide an unrestrictive flow of refrigerant through said flow control means between said second opening in the lower portions in each of said evaporator and condenser;

a defrost flow conduit connected between said first openings in each of said condenser and said evaporator;

a pressure responsive valve in said defrost flow conduit being operable to a closed position when operation of said compressor creates a refrigerant pressure differential in said refrigeration system, and being operable to an open position when said pressure differential is equalized after said compressor operation terminates, so that a nonrestrictive refrigerant flow path is established through said defrost flow passage between said first opening in the upper portions in each of said condenser and said evaporator and simultaneously through said liquid line between the second openings in the lower portion of said condenser and said evaporator, thereby allowing the warmer gaseous refrigerant, when present in the condenser, to flow from the upper portion of said condenser through said defrost flow conduit into the upper portion of said evaporator to raise the temperature of said evaporator while the temperature of the refrigerant in said suction conduit at said point raised by refrigerant migrating into said line from said compressor sensed by said temperature responsive sensing means causes said flow control means to open to allow the warmed refrigerant in the lower portion of said evaporator to flow unrestricted through said liquid line into the lower portion of said condenser thereby completing an unrestricted defrost circuit between said condenser and evaporator through said liquid line and said defrost flow conduit.

2. An air conditioning apparatus for conditioning air in an enclosure having a wall opening comprising:

a housing having openings on opposite sides thereof adapted to be positioned in the wall opening with the opening on one side of said housing facing the outdoors and the opening on the other side of said housing facing the enclosure;

a central chamber defined by spaced partition means dividing said housing into an evaporator compartment and a condenser compartment;

a fan shroud partition means in each of said compartments substantially dividing said compartments into inlet and outlet sections, each of said sections having an opening in both the indoor and outdoor facing side of said housing; a fan within each of said shrouds for circulating air through each of said compartments in a direction from said inlet section to said outlet section;

a first damper slidably arranged in the indoor facing side of said housing being associated with the indoor facing openings of said compartments; a second damper slidably arranged in the outdoor facing side of said housing being associated with the outdoor facing opening of said compartments;

a refrigeration system for use in a reverse air cycle type heat pump, said refrigeration system being of the type having a refrigerant capable of boiling under relatively low pressure to absorb heat and condensing under relatively high pressure to expel heat including:

a compressor casing for containing a high pressure refrigerant, said casing having an inlet port and an outlet port;

a compressor in said casing for compressing said refrigerant in gaseous phase;

a condenser having a first opening in the upper portion and a second opening in the lower portion thereof;

a discharge conduit connecting said condenser first opening to said compressor outlet;

an evaporator arranged above said condenser and said compressor having a first opening in the upper portion and a second opening in the lower portion thereof;

a liquid conduit connecting the second openings in the lower portion in each of said condenser and said evaporator;

a suction conduit connecting said first opening of said evaporator to said compressor inlet;

a means for regulating the flow of refrigerant through said liquid conduit including a flow control means in said liquid conduit, a temperature responsive sensing means for controlling the flow of refrigerant through said flow control means, said temperature responsive means is arranged to sense the temperature of refrigerant in said suction line at a point relative to said compressor wherein the temperature of refrigerant at said point is in a range that will cause said sensing means to effectively control the flow of refrigerant through said flow control means during operation of said compressor at a flow rate which insures efficient operation of said evaporator and being responsive to the temperature of high pressure refrigerant migrating from said compressor casing to said point when said compressor operation terminates to provide an unrestrictive flow of refrigerant through said flow control means between said second opening in the lower portions in each of said evaporator and condenser;

a defrost flow conduit connected between said first openings in each of said condenser and said evaporator;

a pressure responsive valve in said defrost flow conduit being operable to a closed position when operation of said compressor creates a refrigerant pressure differential in said refrigeration system, and being operable to an open position when said pressure differential is equalized after said compressor operation terminates, so that a nonrestrictive refrigerant flow path is established through said defrost flow passage between said first opening in the upper portions in each of said condenser and said evaporator and simultaneously through said liquid line between the second openings in the lower portion of said condenser and said evaporator, thereby allowing the warmer gaseous refrigerant, when present in the condenser, to flow from the upper portion of said condenser through said defrost flow conduit into the upper portion of said evaporator to raise the temperature of said evaporator while the temperature of the refrigerant in said suction conduit at said point raised by refrigerant migrating into said line from said compressor sensed by said temperature responsive sensing means causes said flow control means to open to allow the warmed refrigerant in the lower portion of said evaporator to flow unrestricted through said liquid line into the lower portion of said condenser thereby completing an unrestricted defrost circuit between said condenser and evaporator through said liquid line and said defrost flow conduit.

* * * * *